United States Patent [19]

Grimwood et al.

[11] 4,159,798

[45] Jul. 3, 1979

[54] DESLUDGER TYPE DISC BOWL CENTRIFUGES

[76] Inventors: Geoffrey L. Grimwood, Shaley House, Wooldale, Holmfirth, near Huddersfield; Joseph F. Jackson, 1, W. Royd Villas, Kingcross Rd., Halifax, both of England

[21] Appl. No.: 908,436

[22] Filed: May 22, 1978

[30] Foreign Application Priority Data

May 24, 1977 [GB] United Kingdom ..... 21773/77

[51] Int. Cl.[2] ..... B04B 1/14

[52] U.S. Cl. ..... 233/20 A

[58] Field of Search ..... 233/20 R, 20 A, 19 R

[56] References Cited

U.S. PATENT DOCUMENTS

| | | | |
|---|---|---|---|
| 2,178,547 | 11/1939 | Bjornstjerna | 233/20 A |
| 2,487,364 | 11/1949 | Ortenblad | 233/20 A |
| 3,765,599 | 10/1973 | Hemfort | 233/20 A |

FOREIGN PATENT DOCUMENTS

| | | | |
|---|---|---|---|
| 2220717 | 1/1973 | Fed. Rep. of Germany | 233/20 A |
| 858617 | 1/1961 | United Kingdom | 233/20 A |

*Primary Examiner*—George H. Krizmanich

*Attorney, Agent, or Firm*—Beveridge, DeGrandi, Kline and Lunsford

[57] ABSTRACT

In a disc bowl centrifuge, means are provided for introducing pressure fluid into a piston chamber serving to operate a discharge valve controlling outlet of processed material from the bowl, which means are such as to allow a pressure substantially higher than atmosphere and sufficient to hold the discharge valve closed against the opening forces exerted thereon by process material subjected to centrifugal force in the bowl.

5 Claims, 1 Drawing Figure

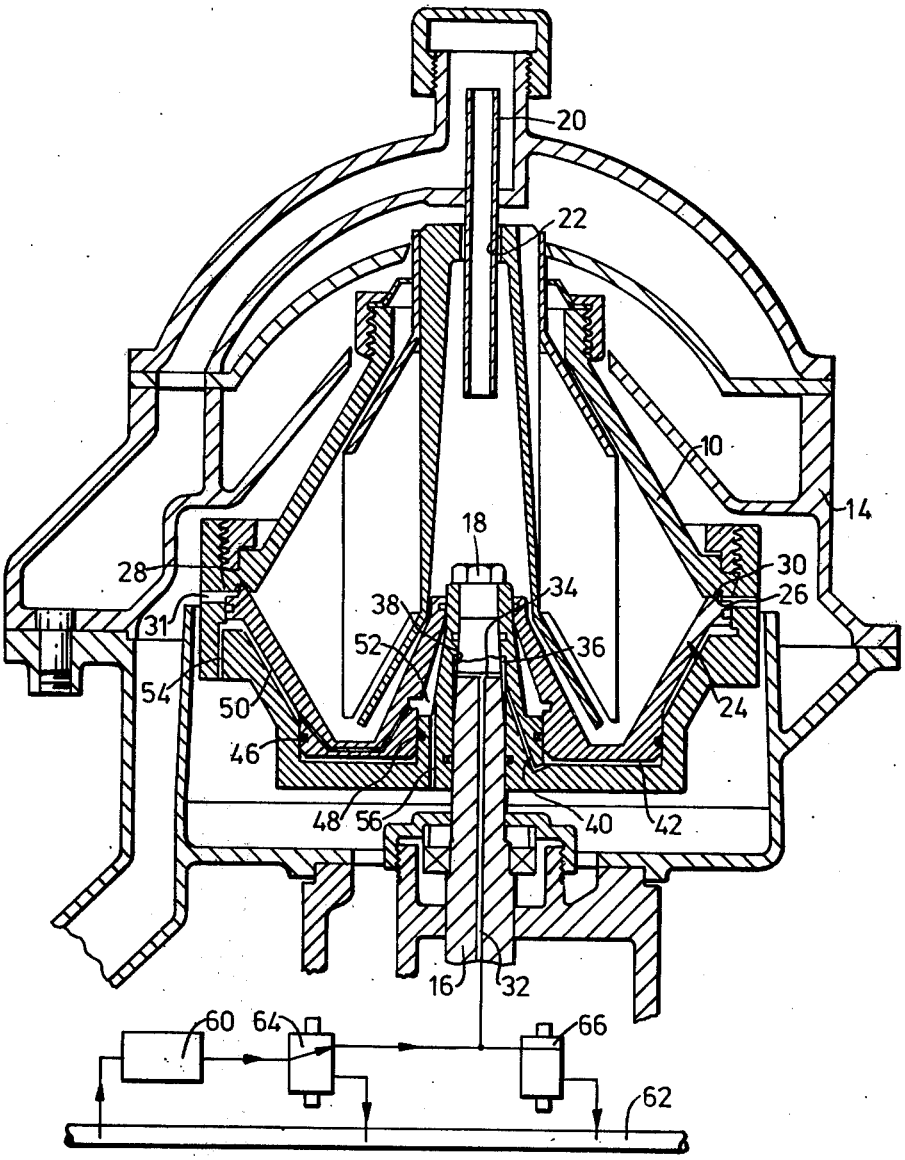
20
22
10
14
18
28
30
26
34
38
31
52
36
54
50
24
46
48
56
40
42
16
32
60
64
66
62

DESLUDGER TYPE DISC BOWL CENTRIFUGES

The present invention relates to disc bowl centrifuges of the separator and clarifyer type and more specifically to self-discharging or "desludger" centrifuges where ports in the rotating bowl wall are periodically opened by the operation of a sliding piston arrangement to permit the discharge of accumulated solids particles.

In known self-discharging disc bowl centrifuges, control of the sliding piston motion for opening and closing the solids discharge ports has been achieved by the admission of fluid into annular collecting grooves at atmospheric pressure where it is conducted under the action of centrifugal force through passages to chambers communicating with a substantial area of the sliding piston face. The fluid in the chamber rotates at substantially the same speed as the centrifuge bowl and is pressurised as a result of the centrifugal effect. The force generated as a result of this pressure acting on the face of the piston serves to urge it into either an open or a closed condition.

A large variety of bowl opening systems are employed by disc bowl centrifuge manufacturers, but all use the above described basic operating principle and are characterised by an arrangement where fluid, substantially at atmospheric pressure, is admitted into a chamber where the pressure exerted on the piston results solely from the centrifugal effect. The known arrangements vary in that some employ a single chamber for closing the bowl while others employ opposed chambers on either side of the piston selectively charged with a fluid to open and close the bowl.

The simplest bowl closing arrangement consists of a piston communicating on its upper face with the fluid being processed within the bowl and on its lower face with the bowl closing fluid. Admission of bowl closing fluid, conveniently water, below the piston urges it upwards and seals the bowl at an annular face between the sliding piston and resilient sealing material housed in the upper bowl surface. The relationship between the respective mass density of the bowl operating fluid, the processed fluid and the effective area on either side of the sliding piston are proportioned so that there is a net force urging the sliding piston to its closed position when closing fluid is admitted below the piston. Release of bowl closing fluid in the chamber below the piston permits the piston to move downwards under the action of the force generated by the pressurised process fluid acting on the upper surface of the piston, opening the discharge ports and allowing process fluid and any accumulated solids to be ejected under the effect of centrifugal force. Closing the discharge ports is effected by re-admission of bowl closing fluid to the chamber below the piston.

It will be appreciated that a major problem encountered in designing the blow closing arrangement of a disc bowl centrifuge relates to obtaining sufficient closing force to maintain the bowl closed under the action of the opposing force generated by the process fluid within the bowl. Where the process fluid and accumulated solids have a density much greater than the bowl closing fluid it is difficult to ensure sufficient force is available to maintain the piston in its raised position. A large number of solutions have been proposed to overcome this problem which either provide an advantageous ratio between the respective areas on either side of the sliding piston or serve to lock the fluid in the chamber below the sliding piston permitting a build up of pressure to counteract any opening force.

While these solutions effectively permit the processing of fluids of high mass density relative to the bowl closing fluid they often suffer certain disadvantages. One particular disadvantage in the case of arrangements where the effective area on which the process fluid acts is reduced to minimise the downward force is the necessary provision of working clearances between the sliding piston and enclosing members into which the solid particles accumulated within the bowl can become lodged. Such a build up of solids can cause malfunction of the piston to occur causing it to fail to either close or open.

It is an objective of the present invention to provide a bowl closing arrangement which is effective but simpler and more reliable than the known arrangements.

In accordance with the present invention, a piston operating fluid is employed which is arranged to be introduced to the operating cylinders for the piston at a pressure substantially higher than atmospheric pressure such that the pressure head is adequate even when acting on a relatively small piston area to urge the piston to its closed position and withstand the opening forces resulting from pressurisation of its upper face by process fluid.

The invention is described further hereinafter, by way of example, with reference to the accompanying drawing which is a longitudinal section through one embodiment of a desludger type disc bowl centrifuge in accordance with the invention.

The illustrated centrifuge comprises a bowl 10 which is adapted to be rotated within a fixed housing 14 about a vertical axis by means of a shaft 16 on which the bowl 10 is rigidly mounted by means of a nut 18. Material to be processed is introduced into the bowl 10 by way of a fixed tube 20 which extends vertically downwardly from a location adjacent the top of the housing 14 through an opening 22 in the top of the bowl.

Slidably located within the lower part of the bowl interior is a generally annular piston 24 whose outer periphery defines an upwardly extending, annular projection 26 which is adapted to co-operate with a resilient sealing material insert 28, contained in an annular groove 30 defined by the wall of the bowl, to form a discharge valve controlling discharge ports 31 in the wall of the bowl. The piston is arranged to be displaceable between an upper position (as illustrated) in which the projection 26 engages the sealing material 28 to prevent discharge of material from the bowl, and a lower position in which, the projection 26 is separated from the resilient material 28 to open the valve and permit discharge of material from the bowl under the action of centrifugal force in a conventional manner. The aforegoing arrangement is conventional.

The most important feature of the present embodiment is that the piston 24 is arranged to be operated by fluid at a pressure substantially above atmospheric. For this purpose, the shaft 16 has a central bore 32 which communicates via cross bores 34 with a tapered, annular chamber 36 formed between a tapered outer surface of the shaft 16 and the wall of a cylindrical bore portion 38 of the bowl 10 through which the shaft extends. The chamber 36 is connected via a passage 40 to a further annular chamber 42 formed at the base of the bowl and containing the piston 24. A rotating gland or distributor (not shown) is provided on the shaft 16 to permit pressurised fluid, preferably a hydraulic type mineral oil to be conducted to the chamber 42, via the bore 32, bores 34, chamber 36 and passage 40, to operate the piston 24. As indicated diagrammatically in the drawing, the pressurised fluid can be derived by the use of a pressure source 60, such as a pump, whose output can be selectably connected to the bore 32 or to sump 62 by way of a first directional control valve 64, which can for example be solenoid operated. Any other suitable means can, however, be used to conduct the pressurised fluid to the chamber 42.

Since the fluid admitted to the chamber 42 is at a high hydraulic pressure, the upward force can be arranged to be sufficiently high to urge the sliding piston 24 into its upper, closed position, sealing the bowl and preventing process fluid loss through the discharge ports 31, the higher hydraulic pressure below the piston being well capable of opposing any opening forces generated by the processed fluid on the piston upper face. To open the bowl 10 and permit discharge of any accumulated solids, the hydraulic pressure below the sliding piston 24 is removed by exhausting the line communicating with the rotating distributor means to substantially lower pressure, e.g. to the sump 62. This may be conveniently carried out using a second solenoid operated directional control valve 66. The force above the piston 24 exerted by the process fluid is sufficient to urge the piston into an open position permitting discharge of said fluid and accumulated solids particles through the ports 31 in the bowl wall.

In the operation of disc bowl centrifuges it is important that the process fluid should not be contaminated by the bowl operating fluid. It may be seen in the arrangement shown in the FIGURE that any operating fluid which should escape by leaking past the piston sealing means 46, 48 is collected in chambers 50, 52 and discharged separately via passages 54, 56 preventing contamination of the process fluid. This arrangement also serves to protect the bowl operating fluid from process contamination.

We claim:

1. A disc bowl centrifuge comprising a bowl adapted to be rotated about a vertical axis, means for introducing material to be processed into the bowl interior, an annular piston disposed within an annular operating chamber in the lower part of said bowl, the outer periphery of said piston defining an upwardly-extending, first annular valve member, a second downwardly-extending annular valve member contained in the wall of said bowl, said first and second valve members co-operating to form a discharge valve controlling at least one discharge port provided in the wall of said bowl, and means for introducing pressure fluid into said piston chamber, said piston being arranged to be displaceable between an upper position in which said first and second valve members co-operate to close said valve to prevent discharge of material from said bowl, and a lower position in which said first and second valve members are mutually spaced to open said valve and permit discharge from said bowl under the action of centrifugal force, said means for introducing pressure fluid into said piston chamber is such as to admit it at a pressure substantially higher than atmospheric pressure, the magnitude of said pressure being such that, when said valve is in its closed position, the pressure in said chamber beneath said piston is sufficient to hold said valve closed irrespective of the magnitude of opening forces exerted on said piston resulting from pressurisation of its upper face by process material subjected to centrifugal force in said bowl.

2. A disc bowl centrifuge at set forth in claim 1 comprising a central downwardly-extending driven spindle on which said bowl is mounted, a source of pressurised fluid and a rotary gland on said spindle, said means for introducing pressure fluid including a passageway through said spindle for conducting pressurised fluid from said fluid source via said rotary gland to said piston chamber.

3. A disc bowl centrifuge as set forth in claim 1 wherein said means for introducing pressure fluid is isolated from said process material containing bowl and is provided with a separate system for leading away any leakage of pressure fluid that may occur, whereby contamination of said process material is prevented.

4. A disc bowl centrifuge as set forth in claim 1 wherein said annular chamber has a smaller axially facing area than the bowl interior.

5. A disc bowl centrifuge as set forth in either claims 1 or 4 wherein said annular chamber is closed from the atmosphere.

* * * * *